United States Patent [19]

Pryor et al.

[11] 3,944,439

[45] Mar. 16, 1976

[54] METHOD OF PREPARING HIGH FATIGUE STRENGTH ALUMINUM ALLOY

[75] Inventors: Michael J. Pryor, Woodbridge; James A. Ford, North Haven; Sheldon W. Dean, Hamden, all of Conn.

[73] Assignee: Swiss Aluminium Limited, Chippis, Switzerland

[22] Filed: Jan. 29, 1975

[21] Appl. No.: 545,070

Related U.S. Application Data

[62] Division of Ser. No. 451,795, March 18, 1974.

[52] U.S. Cl. ..... 148/2; 148/11.5 A

[51] Int. Cl.[2] ..... C22F 1/04

[58] Field of Search ..... 148/2, 11.5 A, 32

[56] References Cited

UNITED STATES PATENTS 3,661,657 5/1972 Wong ..... 148/11.5 A

*Primary Examiner*—R. Dean

*Attorney, Agent, or Firm*—Robert H. Bachman; David A. Jackson

[57] ABSTRACT

The present invention consists of an aluminum alloy having a high fatigue strength which is particularly suited for use in the fabrication of printing plates for offset lithography. The alloy contains from 0.2 to 0.75% magnesium, from 0.45 to 0.7% copper, from 0.1 to 0.7% iron and up to 0.3% silicon. The alloy, when processed according to the process of the present invention possesses a uniquely high fatigue strength.

6 Claims, No Drawings

METHOD OF PREPARING HIGH FATIGUE STRENGTH ALUMINUM ALLOY

This is a Division of application Ser. No. 451,795, filed Mar. 18, 1974.

BACKGROUND OF THE INVENTION

Offset lithography is a widely used printing process which utilizes a printing plate which has been treated so that certain portions of the plate are water receptive and other portions of the plate are receptive to an oil base ink. The printing process consists of first applying water to the sheet and then an oil base ink. After the alternate application of water and ink the aluminum sheet is then placed in contact with a rubber roll and a portion of the ink on the aluminum sheet is transferred to the rubber roll. The rubber roll is then placed in contact with a sheet of paper and the image which results on the paper is directly related to the original surface condition of the aluminum sheet. The aluminum sheet is usually prepared through the use of a photographic process. In one variation of this process, a photosensitive polymer is applied to the surface of the sheet and a pattern of light corresponding to the desired printed image is caused to impinge on the photosensitive polymer. Subsequently, a developer removes all the photosensitive polymer which was not exposed to light. Because of surface tension effects the oil base ink will adhere to the areas where the photosensitive polymer remains and the water will adhere to areas where the original surface of the aluminum sheet is exposed. Large numbers of copies may be made from one printing plate, sometimes in excess of one million. Because the resultant printed image depends on the surface condition of the aluminum sheet, it is highly important that the original surface of the sheet be smooth, flat and free from defects.

Aluminum alloys are widely used in the production of printing plates for use in offset lithography. Difficulties are encountered when aluminum alloy printing plates are used in extremely long production runs. These difficulties include fatigue cracking of the alloys and excessive wear of the alloy. These problems of low fatigue strength and excessive wear are both related to the inability of the alloy to further work harden in service. Commonly used aluminum alloys, Aluminum Association designation 3003 and 1100 have a fatigue strength in hard tempers of about 10,000 psi at 500,000,000 reversals.

These problems cannot be solved by the substitution of higher strength aluminum alloys because present commercial processes cannot produce material having the required width, flatness and surface finish in alloys having a tensile strength in excess of 35,000 psi.

The preceeding difficulties may be largely overcome through the use of the alloy of the present invention. The alloy of the present invention has a fatigue strength of between 13,000 and 15,000 psi and a tensile strength of about 25,000 psi. When used in a partially annealed condition, these strengths may be obtained while the alloy retains sufficient work hardening capabilities so as to minimize wear.

SUMMARY OF THE INVENTION

The alloy of the present invention contains from 0.2 to 0.75% magnesium, from 0.45 to 0.7% copper, from 0.1 to 0.7% iron and up to 0.3% silicon, balance essentially aluminum. This alloy in the partially annealed condition possesses a moderate tensile strength of about 25,000 psi. The tensile strength is comparable to that of the commonly used aluminum alloys while the fatigue strength of 13,000 to 15,000 psi, is from 30 to 50% greater than the fatigue strength of other alloys commonly used for litho plates.

The alloy of the present invention may be fabricated using conventional techniques and may be surface grained for lithography purposes using techniques similar to those used for current alloys. Additional advantages and benefits of the present invention will be made more apparent with reference to the following Description of the Preferred Embodiments in combination with the claims.

DESCRIPTION OF THE PREFERRED EMBODIMENTS

The composition of the present invention is given in weight percent in the following description unless otherwise specified.

The broad and preferred composition limits for the alloy of the present invention are given in Table I below:

TABLE I

| | Broad | Preferred |
|---|---|---|
| Magnesium | .2 – .75 | .4 – .6 |
| Copper | .45 – .7 | .5 – .6 |
| Iron | .1 – .7 | .4 – .65 |
| Silicon | 0 – .3 | — |
| Manganese | 0 – .05 | 0 – .05 |
| Zinc | 0 – .05 | 0 – .05 |
| Titanium | 0 – .03 | .0075 – .015 |
| Chromium | 0 – .05 | 0 – .05 |
| Boron | 0 – .02 | .005 – .015 |

The essential components of the alloy are magnesium, copper, iron and silicon. The other components listed in Table I may be present in concentrations up to those listed in the Table without adverse effect. Titanium may be present as a purposeful addition for the purposes of grain refinement. Naturally, any of the foregoing non-essential elements may be present in levels as low as 0.001%.

The alloying elements of the present alloy have been selected so that the resultant alloy in its final condition has a minimum of alloying elements present out of solid solution. Table II lists the approximate solid solubility of the alloying additions of the present invention at a temperature of 625°F. This temperature was chosen since it is representative of the final full annealing temperature disclosed in the present application. Also shown in Table II are the approximate percentages of alloying elements of the present invention out of solution under the worst possible condition which is when the alloying elements are present in their maximum amounts. The sum of the alloying elements out of solution at 625°F is seen to be less than 0.9%. The alloying composition of the present invention is preferably chosen to have a maximum amount of alloying additions out of solution to be less than 0.9% and most preferably less than 0.7%. The alloying composition must, of course, still fall within the limits set forth in Table I.

TABLE II

| Element | Solubility in Aluminum at 625°F (approx.) | Max. Allowed in Present Alloy | Max. out of Solution in Present Alloy at 625°F |
|---|---|---|---|
| Mg | 8.0 | .75 | — |
| Cu | 2.0 | .7 | — |
| Fe | .02 | .7 | .68 |
| Si | .15 | .3 | .15 |
| Mn | .05 | .05 | — |
| Zn | 45.0 | .05 | — |
| Ti | .01 | .03 | .02 |
| Cr | .01 | .05 | .04 |
| B | .005 | .015 | .010 |

The present invention will be made more clear through reference to the following illustrative examples.

EXAMPLE I

A series of alloys containing various amounts of magnesium, copper and silicon were cast for evaluation. The composition of the ingots is given in Table III, along with the details of the initial homogenization given the ingots. The ingots were hot rolled from 1.5 inches to a final gage of 0.2 inch at a temperature of 825°F. The ingots were reheated for 5 minutes after each 0.1 inch reduction. The ingots were then cold rolled from 0.2 to 0.1 inch using a reduction of about 10% per pass. The cold rolled ingots were then annealed for 3 hours at 625°F. Some of the ingots received controlled heating and cooling at a rate of 25°F/hr. before and after this anneal to simulate commercial large coil practice. Those ingots which received controlled cooling and heating are designated in Table III.

The annealed ingots were then cold rolled at 10% per pass to 0.060 inch or to 0.043 inch. The cold worked ingots were then annealed at 625°F for 3 hours. For this anneal all alloys received the control cooling and heating rate of 25°F/hr. The annealed material was then cold rolled 10% per pass to a thickness of 0.030 inch. This represents a 50% reduction for the 0.060 inch gage material and a 30% reduction for the 0.043 inch gage material. As a final anneal the alloys received a partial anneal as described in Table III.

EXAMPLE II

The alloys prepared in Example I were evaluated for mechanical properties, yield strength, ultimate tensile strength and elongation. The results are listed in Table III. The alloys were also tested for fatigue strength and the fatigue strength listed in Table III is the stress in ksi which the alloy withstood for $10^7$ cycles.

TABLE III

| Analyzed Alloy Mg | Analyzed Alloy Cu | Other | Ident. | Homog. | Controlled Heating & Cooling Intermediate Annealing | Final Reduct. % CW to 0.030" | Partial Anneal | YS ksi | UTS ksi | % E | Limit $10^7$ Cycles in ksi |
|---|---|---|---|---|---|---|---|---|---|---|---|
| .86 | .48 | .25 Si | 11A | H 950/12–16 hrs. | No | 50 | 425/1 hr. | 25.0 | 29.3 | 6.0 | 14.3 |
| .86 | .48 | .25 Si | 11B | H 950/12–16 hrs. | No | 30 | 275/1 hr. | 25.7 | 28.7 | 3.0 | 13.0 |
| .35 | .46 | .11 Si | 12A | H 950/12–16 hrs. | No | 50 | 275/1 hr. | 26.1 | 28.5 | 4.0 | 13.4 |
| .35 | .46 | .11 Si | 12B | H 950/12–16 hrs. | No | 30 | No | 24.4 | 24.7 | 2.0 | 13.0 |
| .76 | .56 | .11 Si | 18 | H 1050–1100/12 hrs.C | No | 50 | 295/1½ hrs. | 28.1 | 31.9 | 4.7 | 14.1 |
| .63 | .38 | .09 Si | 20 | H 1050–1100/12 hrs.C | No | 50 | 405/1½ hrs. | 24.2 | 28.5 | 5.5 | 14.0 |
| .69 | .54 | .10 Si | 22 | No | No | 50 | 295/1½ hrs. | 26.3 | 30.6 | 4.2 | 14.9 |
| .45 | .54 | .10 Si | 26A | H 1050–1100/12 hrs.C | Yes | 50 | No | 26.3 | 26.6 | 2.0 | 13.8 |
| .45 | .54 | .10 Si | 26B | H 1050–1100/12 hrs.C | Yes | 50 | H 295/3 hrs.C | 25.2 | 29.8 | 5.5 | 15.7 |
| 1.2 | .06 | .2 Si | 5050-H36* | H 1050–1100/12 hrs.C | Yes | 50 | 295/3 hrs. | 23.2 | 26.0 | 4.0 | 11+[1] |
| — | .15 | 1.2 Mn .2 Si | 3003-H16 | H 1100–1150/8 hrs.C | No | 50 | No | 25.0 | 27.9 | 3.5 | 11.6 |
| 16% Clad 5050-H36 (0.011") | | | | Not Known | | | Yes | 21.4 | 24.7 | 5.9 | 11.2 |
| Bare 1100-H16 (0.011") | | | | Not Known | | | No | 20.7 | 21.5 | 4.2 | 9.1 |

H — 50°/hr. heat to temperature
C — 50°/hr. cool from temperature
*10% Clad with 1145 alloy.
[1]Passed at 11 ksi and failed at $4 \times 10^6$ at 12 ksi.

It is noteworthy that the alloys of the present invention have average fatigue strengths on the order of 14,000 psi whereas conventional alloys used for the fabrication of lithography plates and listed in Table III have fatigue strengths on the order of 10 ksi. The improvement in fatigue strength is achieved without significant change in other mechanical properties. The yield strength and ultimate tensile strength of the alloys of the present invention are slightly higher than the conventional alloys, while the elongation of the present alloys is somewhat less than the elongation of the commercial alloys tested. The yield strength may be controlled by controlling the final partial anneal. The data in Table III indicates the importance of the final partial anneal in achieving superior fatigue strength. For example, the alloy identified as 26 has a fatigue strength of 13 ksi in the non-partially annealed condition and a fatigue strength of 15.7 ksi after the partial anneal, an improvement of 13.7%. The partial anneal also increased the elongation, which is a measure of residual work hardened capacity, from 2.0 to 5.5%. The yield strength was not significantly affected by the stabilization while the ultimate tensile strength was only slightly increased (3–5,000 psi). Thus, it can be seen that the partial anneal plays an important role in producing material having a high fatigue strength. The partial anneal conditions were selected to provide a yield strength of approximately 25,000 ksi. Material having a yield strength of 25,000 ksi may readily be fabricated using conventional commercial techniques.

EXAMPLE III

The samples of Alloys 12A, 12B, 26A and 26B were further evaluated for suitability for use in lithography plates by fabricating the lithographic printing plates from these alloys. The evaluation of the resultant printed images indicated that the alloys were highly suited for the fabrication of printing plates. The printed image was extremely sharp and there was no evidence of defects caused by the surface condition of the alloy.

In summary, the process which is preferred for preparation of the alloys of the present invention consists of the following steps:

1. Cast the alloy using conventional processes such as used for the casting of 1100 type alloys. Titanium may be added for grain refinement in the amounts listed in Table I.
2. Homogenize at a temperature of between 900° and 1150°F for a time of between 2 and 24 hours. Care must be taken to avoid exceeding the solidus temperature which is dependent on the exact composition of the alloy.
3. Hot roll at a temperature between 750° and 900°F.
4. Cold roll and anneal to penultimate gage. Intermediate anneals should be performed at temperatures between 600° and 750°F for periods from 1 minute to 6 hours.
5. The final cold reduction should be at least 20%.
6. The final partial anneal should be performed so that the resultant material has a 0.2% offset yield strength of between 22 and 28,000 psi. In general, the final anneal will be performed at temperatures between 250° and 500°F for times of between 1 minute and 4 hours.

The resultant aluminum alloy is characterized by having a non-recrystallized grain structure, a yield strength of between 22 and 28,000 psi. The elongation of the resultant alloy is preferably at least 5%.

The aluminum alloy of the present invention treated according to the process of the present invention has superior fatigue properties and is highly suited for use in the production of long run aluminum lithography printing plates. For extremely long run printing plates it is common commercial practice to apply a layer of electroplated copper to the surface of the aluminum printing plate so as to provide a wear resistant surface. The alloy of the present invention can be easily plated with copper and the resulting copper plated surface is free from defects. The thickness of the copper plate layer will generally fall between 0.0005 and 0.005 inch and may be applied by any of several well known conventional techniques.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of preparing a high fatigue strength aluminum alloy comprising:

A. casting an aluminum alloy consisting essentially of from 0.2 to 0.75% magnesium, from 0.45 to 0.7% copper, from 0.1 to 0.7% iron, from 0.001 to 0.3% silicon, balance aluminum;

B. homogenizing at a temperature of between 900° and 1150°F, but below the solidus temperature of the alloy, for a period of time of between 2 and 24 hours;

C. hot rolling at a temperature of between 750° and 900°F;

D. cold rolling and annealing to penultimate gage;

E. applying a final cold reduction of at least 20%; and

F. partially annealing to produce a high fatigue strength aluminum alloy.

2. A method according to claim 1 wherein said alloy contains a material selected from the group consisting of from 0.001 to 0.5% manganese, from 0.001 to 0.05% zinc, from 0.001 to 0.3% titanium, from 0.001 to 0.05% chromium, from 0.001 to 0.02% boron, and mixtures thereof.

3. A method according to claim 1 wherein the annealing in step (D) is at a temperature of from 600° to 750°F for from 1 minute to 6 hours.

4. A method according to claim 1 wherein said partial annealing in step (F) is at a temperature of from 250° to 500°F for from 1 minute to 4 hours.

5. A method according to claim 4 wherein said partial annealing in step (F) produces a high fatigue strength aluminum alloy having a 0.2% offset yield strength of between 22,000 and 28,000 psi.

6. A method according to claim 1 wherein the resultant high fatigue strength aluminum alloy is suitable for use in long run lithographic printing plates.

* * * * *